US010179403B1

(12) United States Patent
Mikhaylenko

(10) Patent No.: US 10,179,403 B1
(45) Date of Patent: Jan. 15, 2019

(54) TILE CUT MARKING DEVICE

(71) Applicant: Vadim Mikhaylenko, Jacksonville, FL (US)

(72) Inventor: Vadim Mikhaylenko, Jacksonville, FL (US)

( * ) Notice: Subject to any disclaimer, the term of this patent is extended or adjusted under 35 U.S.C. 154(b) by 0 days.

(21) Appl. No.: 15/973,435

(22) Filed: May 7, 2018

Related U.S. Application Data

(60) Provisional application No. 62/503,010, filed on May 8, 2017.

(51) Int. Cl.
*B25H 7/04* (2006.01)

(52) U.S. Cl.
CPC ..... *B25H 7/04* (2013.01)

(58) Field of Classification Search
CPC ..... B25H 7/04; B43L 7/04; B43L 7/08
USPC ..... 33/26, 526, 527
See application file for complete search history.

(56) References Cited

U.S. PATENT DOCUMENTS

| | | | | |
|---|---|---|---|---|
| 3,885,315 | A * | 5/1975 | Polselli | B25H 7/00 33/42 |
| 4,680,864 | A * | 7/1987 | Heagerty | B43L 9/00 33/26 |
| 5,862,601 | A | 1/1999 | O'Brien et al. | |
| 7,194,810 | B2 * | 3/2007 | Shai | B25H 7/04 33/42 |
| 7,451,547 | B1 * | 11/2008 | Lantinen | B25H 7/04 33/32.2 |
| 7,685,730 | B2 * | 3/2010 | Dozier | B25H 7/02 33/527 |
| 2005/0246908 | A1 * | 11/2005 | Cotton | A47G 27/0487 33/41.5 |

* cited by examiner

*Primary Examiner* — Yaritza Guadalupe
(74) *Attorney, Agent, or Firm* — Mark Young, P.A.

(57) ABSTRACT

A tile cut marking device includes a wheeled cart that rides against a wall and floor junction, a step or curb. A rail extends from the cart. A marker holder is attached towards the end of the rail opposite the cart. A handle is attached to the rail between the marker holder and cart. The marker (positioned one full tile length from the boundary including space for grout lines) draws a line on laid tiles to be cut and then re-laid as the last row adjacent the boundary (e.g., wall).

20 Claims, 9 Drawing Sheets

TILE CUT MARKING DEVICE

RELATED APPLICATION

This application is a nonprovisional of and claims the benefit of priority of U.S. Provisional Application No. 62/503,010 filed May 8, 2018, the entire contents of which are incorporated herein.

FIELD OF THE INVENTION

This invention relates generally to a tool for marking flooring tiles, and, more particularly, to a tool for marking flooring tiles for cutting to fit against a wall.

BACKGROUND

Cutting is the most challenging part of the process of laying ceramic tile or other flooring material, even for a highly qualified installer. Cutting may consume up to 30-40% of an installer's time. Wasted time cuts into an installer's profit margin, as most installers are paid by the square foot. The quicker an installer can complete a job, the quicker the installer can move on to the next job.

Good marking is a prerequisite for good cutting. Cuts are made along markings. The markings may be lines, groups of joined line segments, curves and/or a combination of the foregoing. If the marking is inaccurate, then even if the cut precisely follows the marking, the result is a piece that fits poorly or may not fit at all. Thus, poor marking inevitably leads to inferior work product, and wasted materials and time.

In some cases marking requires higher than average level of skill and intelligence for the installer. While laying rectangular tile in a rectangular room with all edges parallel to the walls (a straight lay tile pattern) may not pose a monumental challenge, other patterns (e.g., diagonal, diamond accent, running bond, herringbone, basket weave, windmill, Versailles and pinwheel) and room shapes (e.g., askew or curved walls, and walls with doorways, alcoves and other discontinuities) substantially increase the level of difficulty. Accurate marking requires knowledge of geometry, skill and experience. Poor marking can substantially compromise the quality of flooring installation, prolongs the time, causes frustration and leads to dissatisfied customers.

Various tile marking tools have been devised in an effort to facilitate accurate marking. One example, described in U.S. Pat. No. 5,862,601, is a marking tool having an elongate case, a spring biased piston that slides within the case, a shaft extending from the piston and out of the case, a pencil attached to the shaft, a guide roller attached to the free end of the shaft, a pair of wheels on the bottom of the case, and a handle. Problems with this type of marking tool are related to its structure. One problem is that the guide roller at the free end does not account for molding and does not maintain the height of the roller relative to the floor. Another problem is that the shaft is always aligned with the handle and cannot pivot relative to the handle. Yet another problem is the spring loading, which complicates maintaining consistent contact with a wall surface. Also, the distance between the guide roller and the pencil cannot be changed, limiting the tool to marking at a single determined distance from a wall, which may not work for many tile sizes and layouts.

The invention is directed to overcoming one or more of the problems and solving one or more of the needs as set forth above.

SUMMARY OF THE INVENTION

To solve one or more of the problems set forth above, in an exemplary implementation of the invention, a tile cut marking device includes a cart with a plurality of wheels that allow the cart to ride against a boundary such as a wall and floor junction or a step, a rail that extends from the cart, a pencil holder at the end of the rail opposite the cart, and a handle attached to the rail between the pencil holder and cart. In use, tiles to be cut are laid in place on a floor, leaving empty the last space, less than one full tile length (including spacing for grout lines from the boundary. As the cart travels against the boundary, the pencil (positioned one full tile length from the boundary) draws a cut line on the tiles. The tiles are cut along the line. After a cut is made, a tile is split into two pieces. The piece of cut tile which was located further from the boundary (e.g., wall) is then laid as the last row adjacent the boundary, after a row of uncut tiles is laid in the place where the marked tiles were laid when marked.

An exemplary tile cut marking device according to principles of the invention includes an elongated support having a first end and a second end. A cart is attached at the first end of the support structure. The cart includes a cart body to which a plurality of wheels are attached. The cart body has a bottom surface, a top surface opposite the bottom surface, a first side surface extending from the top surface to the bottom surface, and a second side surface opposite the first side surface and extending from the top surface to the bottom surface. The plurality of wheels include a pair of lower wheels attached to the first side surface and extending equally below the bottom surface, and at least one upper wheel (preferably at least a pair of upper wheels) attached to the top surface and extending outwardly beyond the second side surface. An axis of rotation of each lower wheel of the pair of lower wheels is horizontal (i.e., generally approximately horizontal). An axis of rotation of each upper wheel of the at least one upper wheel is vertical (i.e., generally approximately vertical). Upper wheels extend outwardly beyond the second side surface. Lower wheels extend downwardly beyond the bottom surface. The distance between the top surface and the bottom surface is at least 0.75 inches. A marker holder is attached to the support structure between the cart and the second end of the support structure. The marker holder includes a holder body. A marking instrument (e.g., pencil or marker) is attached to the marker holder. The marking instrument includes an end with a marking tip. The end with the marking tip extends downwardly below the marker holder a determined distance for marking tiles to be cut. A handle is attached to the support structure between the cart and marker holder.

In one embodiment, the elongated support is a bent rod with a vertical segment about 3 to 5 inches in desired length and a horizontal segment about 20 to 26 inches in length. This dimension may vary depending upon the size of tile. The cart body includes a channel in which a portion of the vertical segment is received. A screw is threadedly received in the cart body and, when the screw is tightened, extends into the channel and exerts force against the portion of the vertical segment received in the channel. When the screw is loosened, it does not apply force against the portion of the vertical segment received in the channel.

The holder body includes a horizontal channel in which a portion of the horizontal segment of the rod is received. A screw is threadedly received in the holder body and, when the screw is tightened, it extends into the horizontal channel and exerts force against the portion of the horizontal segment received in the horizontal channel. When the screw is loosened, it does not apply force against the portion of the horizontal segment received in the horizontal channel.

The holder body also includes a vertical channel in which a portion of the marking instrument is received. A screw is threadedly received in the holder body and, when the second screw is tightened, it extends into the vertical channel and exerts force against the portion of the marking instrument received in the vertical channel. When the screw is loosened, it does not apply force against the portion of the marking instrument received in the vertical channel.

The holder body may also include a bubble level attached to the top surface of the holder body. The level aids a user in maintaining appropriate orientation of the tool during use.

The handle is attached to the support structure between the cart and marker holder. The handle includes a horizontal channel in which a portion of the horizontal segment is received. A screw is threadedly received in the handle and, when the second screw is tightened, extending into the horizontal channel and exerting force against the portion of the horizontal segment received in the horizontal channel, and, when the screw is loosened, not applying force against the portion of the horizontal segment received in the horizontal channel.

In use, the cart is positioned against a wall and floor, with the upper wheels against the wall (or baseboard) and the lower wheels on the floor. The marker is positioned a full tile distance, including grout lines, from the wall.

To facilitate configuring the tool and to account for variation of tile sizes, a worker may determine where a tile that will occupy the row immediately adjacent to (i.e., abutting) a boundary, such as a wall, should be cut. The worker will mark that cut line on the tile. When the full uncut tile is positioned in the next to last row, the marker of the device may be positioned precisely on that marked cut line. Then, the device may be moved with the marker marking the all of the tiles in the next to last row. This next to last row of tiles is marked by moving the cart along the wall with the rail aligned with the primary axis of the tiles to be cut. In this manner, all of the tiles in the next to last row are consistently marked. After the tiles are marked, they are removed for cutting. Then, full uncut tiles are laid to occupy the next to last row. After cutting the marked tiles, the portions of those tiles further from the wall will be laid as the row immediately adjacent to the wall. If the wall is curved, the screw in the cart is loosened to allow pivoting motion of the cart relative to the rail as the cart travels along the wall and floor, which allows controlling desired orientation of the rail, while the device is moving. If the wall is straight, whether or not angled, the screw may be tightened, fixing the cart in relation to the rail, which fixes the desired orientation of the rail, while the device is moving.

BRIEF DESCRIPTION OF THE DRAWINGS

The foregoing and other aspects, objects, features and advantages of the invention will become better understood with reference to the following description, appended claims, and accompanying drawings, where:

Figure 1:
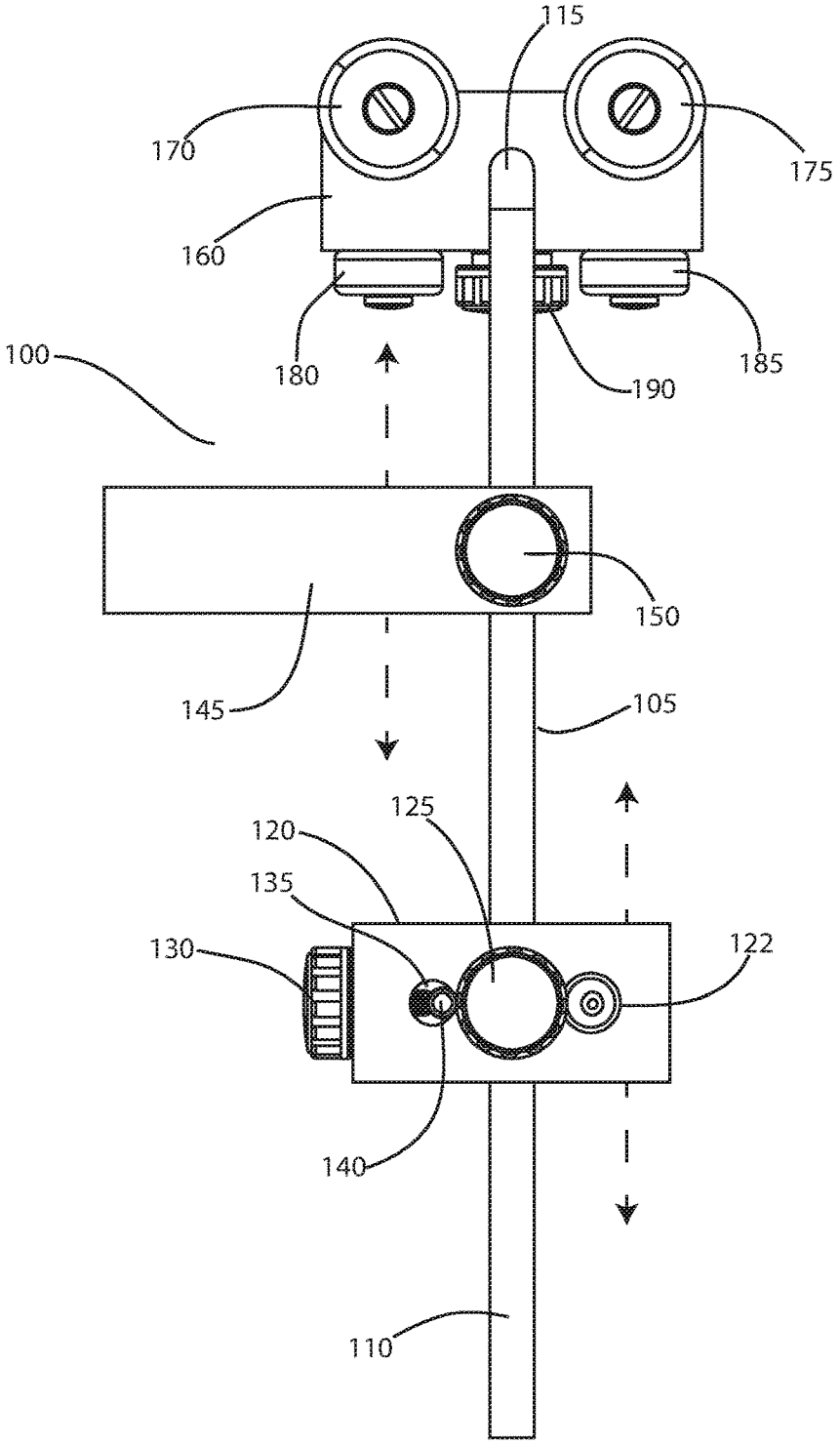
FIG. 1 is a plan view of an exemplary tile cut marker tool according to principles of the invention.
Figure 2:
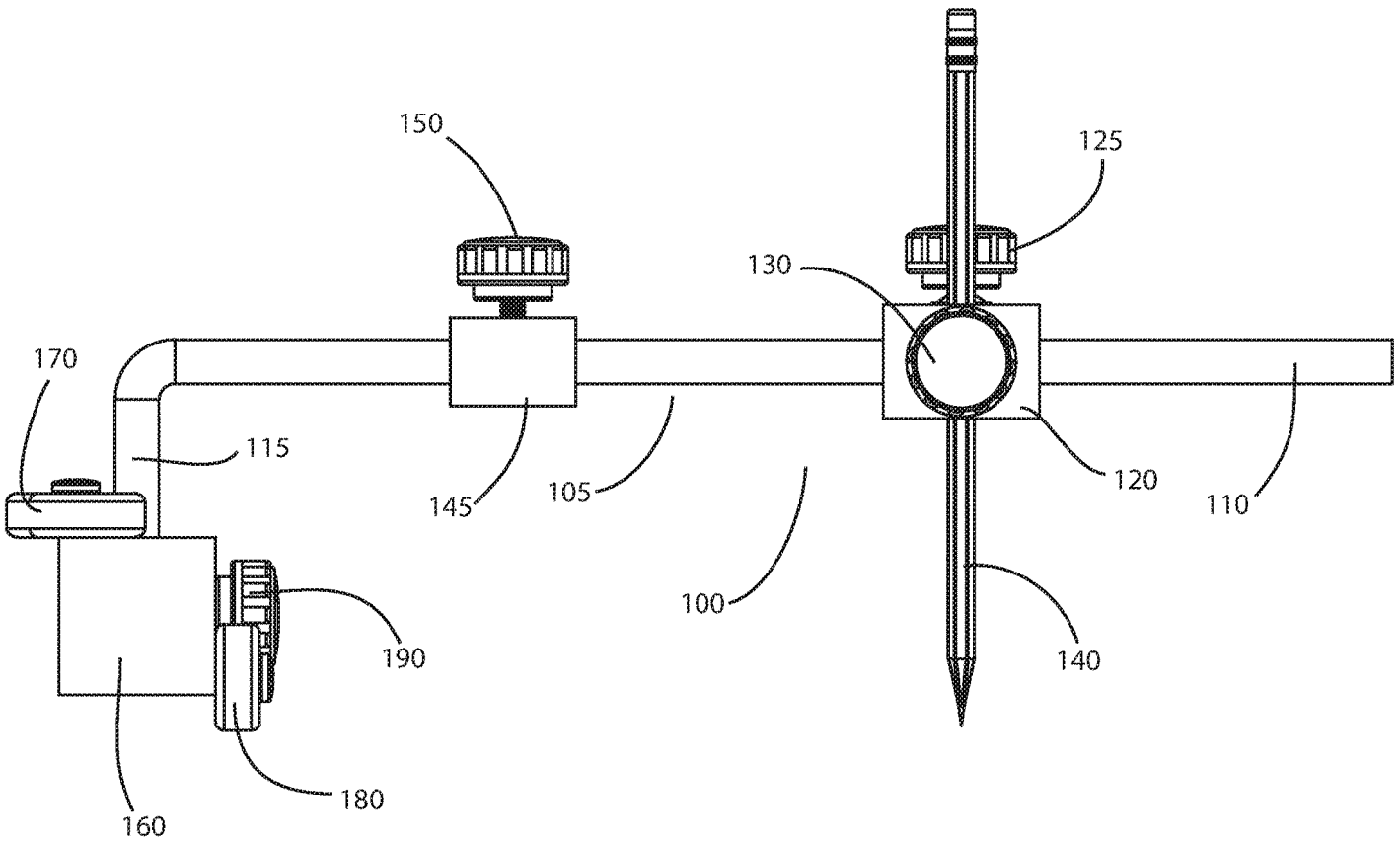
FIG. 2 is a side view of an exemplary tile cut marker tool according to principles of the invention.
Figure 3:
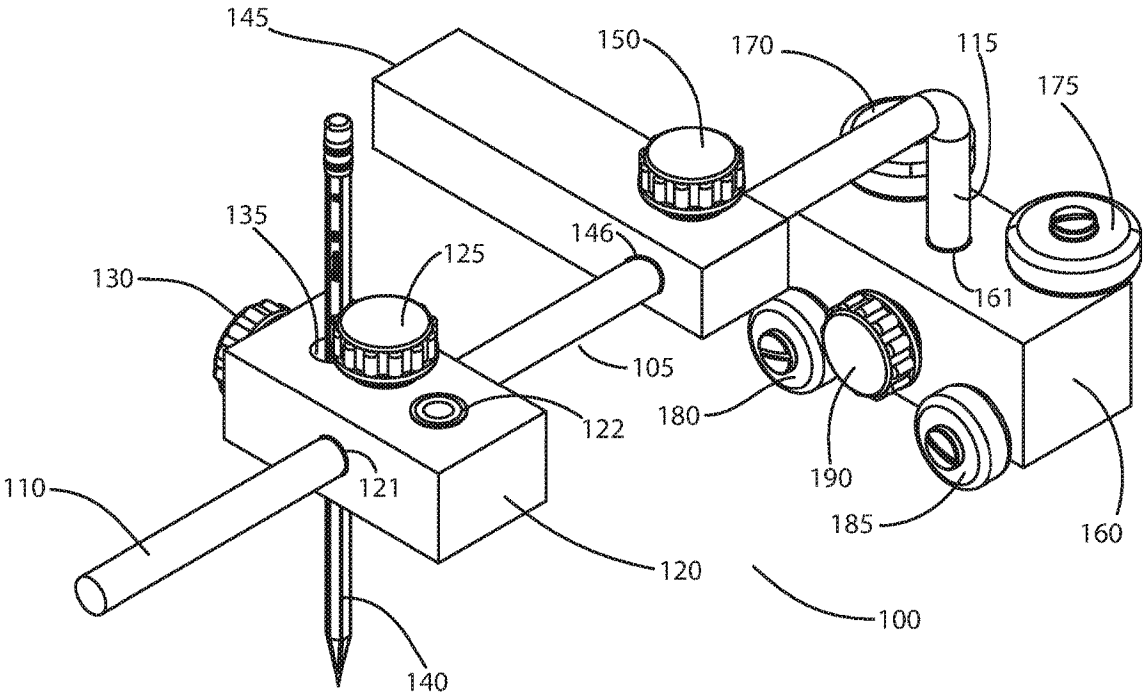
FIG. 3 is a top perspective view of an exemplary tile cut marker tool according to principles of the invention.
Figure 4:
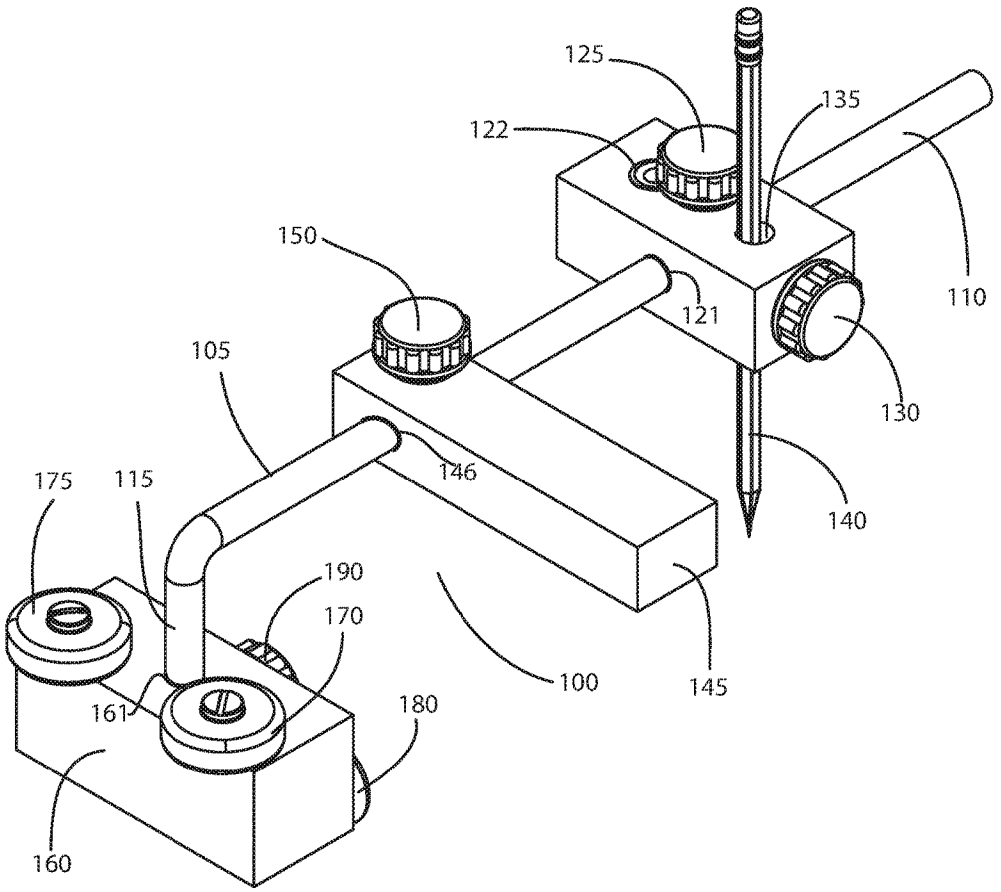
FIG. 4 is another top perspective view of an exemplary tile cut marker tool according to principles of the invention.

Those skilled in the art will appreciate that the figures are not intended to be drawn to any particular scale; nor are the figures intended to illustrate every embodiment of the invention. The invention is not limited to the exemplary embodiments depicted in the figures or the specific components, configurations, shapes, relative sizes, ornamental aspects or proportions as shown in the figures.

DETAILED DESCRIPTION

Referring to FIGS. 1 through 4 an exemplary tile cut marker tool 100 according to principles of the invention is conceptually illustrated. The tool 100 includes a rail 105 a marker holder 120, handle 145, and a wall cart (i.e., cart) 160. The rail 105 is a generally L-shaped rigid support to which the marker holder 120, handle 145, and cart 160 are adjustably attached. The rail 105 includes a generally horizontal portion 110 and a generally vertical portion 115. The rail 105 may be comprised of a bent rod, a cast or molded rod, or a pair of rod segments adjoined by welding or bonding. The rail 105 is a support structure. While an L-shaped rod support structure is preferred, other configurations may be utilized without departing from the scope of the invention. By way of example and not limitation, the rail may be comprised of flat bar, channel, angle and other shaped supports.

The rail 105 is longer than the primary axis of the tile to be marked. The primary axis is the dimension of the tile relative to the wall, including grout lines. For square tile oriented with a side parallel to a wall, the primary axis is a side of the square tile, plus grout lines. For square tile oriented in a diamond pattern with a corner facing the wall, the distance from corner to corner (i.e., corners which are located on a line which is perpendicular to the wall), plus grout lines, is the primary axis. In one embodiment, the length of the horizontal portion 110 of the rail 105 is about 20 to 26 inches, preferably 24 or 23 inches, and the length of the vertical portion is about 3 to 5 inches. Such a rail can be used to mark a range of tile sizes. Rails of various horizontal and vertical dimensions may be utilized within the spirit and scope of the invention. The length of the rail is determined by the dimensions of the tile being set, and is preferably longer than the length (primary axis) of the tile.

The rail 105 is comprised of a generally rigid corrosion resistant material. Nonlimiting examples include aluminum and steel. By way of example and not limitation, stainless steel round bar with a diameter of ⅜-inch may be used. Coatings (e.g., zinc coating on plain steel) may be applied to enhance corrosion resistance.

The handle 145 is disposed between the marker holder 120 and the cart 160. The handle 145 is gripped by a user. Gripping the handle 145, a user moves the tool along a wall to mark tiles, as discussed in greater detail below. A channel 146 extends through the handle 145. The channel 146 is sized and shaped to receive a horizontal portion 110 of the rail 105. A screw 150 (e.g., a thumbscrew, wingscrew or other screw) that is threadedly received in the handle secures the rail 105 to the handle 145 when the end of the threaded screw is tightened against a portion of the horizontal segment 110 of the rail 105 received in the channel 146. Thus, the screw 150 performs the function of a set screw.

The exemplary handle 145 is a generally cuboid in shape. However, other shapes, including cylindrical, and ergonomic handle shapes, may be utilized without departing from the scope of the invention.

The handle 145 should extend from the horizontal segment 110 of the rail 105 a sufficient distance for comfortable gripping in a hand. Such a distance may be, for example, 4 to 5 inches. The width and depth of the handle should be sufficient, but not excessive, for comfortable gripping and control. In one exemplary embodiment, the handle is about 6 inches long, 1.5 inches in width and 0.75 inches in depth (height), with the center of the channel 146 being about 1.5 inches from an end.

The exemplary handle is removable and adjustable. The handle may be arranged to extend from one side or the other side of the rail 105. In FIG. 1, the handle 145 is shown extending primarily to the left of the rail 105. The same handle 145 may be arranged to extend to the right of the rail 105. Additionally, the handle 145 may be positioned closer to the vertical segment 115 or closer to the free end of the horizontal segment 110, by loosening the screw 150 and sliding the handle 145 along the horizontal segment 110. The handle may be removed by loosening the screw 150 and sliding the handle 145 off the horizontal segment 110, after the marker holder 120 is similarly removed.

The handle 145 may be comprised of any material suitable for providing a supportive grip and receiving the horizontal segment 110 and the screw 150. Plastics, metals and composites may be used. In an exemplary embodiment, the handle 145 is comprised of a corrosion resistant metal, such as aluminum, stainless steel or zinc coated steel.

The marker holder 120 includes a generally vertical channel 135 for receiving a marker 140, such as a pencil or pen. A screw 130 is threadedly received by the holder 120 in alignment with the channel 135. When tightened, the screw 130 secures the marker 140 in the channel 135 of the holder 120.

A channel 121 extends through the holder 120. The channel 121 is sized and shaped to receive a horizontal portion 110 of the rail 105. A screw 125 (e.g., a thumbscrew, wingscrew or other screw) that is threadedly received in the handle secures the rail 105 to the holder 120 when the end of the threaded screw is tightened against a portion of the horizontal segment 110 of the rail 105 received in the channel 121. Thus, the screw 125 performs the function of a set screw.

A bubble level 122 is provided on the top surface of the marker holder 120. The bubble level indicates level and out-of-level orientation of the horizontal segment 105 of the tool 100. During use, the user will typically endeavor to maintain the horizontal segment 105 of the tool 100 in generally level (horizontal) alignment.

The exemplary holder 120 is a generally cuboid in shape. However, other shapes, including cylindrical, may be utilized without departing from the scope of the invention.

The length, width and depth of the holder 120 should be sufficient to support the marker 140 and bubble level 122, and receive the screws 125 and 130 and engaged portion of the horizontal segment 110 of the rail 105. In one exemplary embodiment, the holder 120 is about 2.5 inches long, 1.5 inches in width and 0.75 inches in depth (height), with the center of the channel 121 being about 1.25 inches (centered along the 2.5 inch length) from an end and about ⅜-inch from the top surface (i.e., centered between the top and bottom).

The exemplary holder is removable and adjustable. The holder may be arranged to locate the marker 140 from one side or the other side of the rail 105. In FIG. 1, the holder 120 is shown locating the marker 140 primarily to the left of the rail 105. The same holder 120 may be arranged to locate the marker 140 to the right of the rail 105. Additionally, the holder 120 may be positioned closer to the vertical segment 115 or closer to the free end of the horizontal segment 110, by loosening the screw 125 and sliding the holder 120 along the horizontal segment 110. The holder may be removed by loosening the screw 125 and sliding the holder 120 off the horizontal segment 110.

The holder 120 may be comprised of any material suitable for providing a supportive structure (i.e., body) for the marker 140 and level 122 and receiving the horizontal segment 110 and the screws 125, 130. Plastics, metals and composites may be used. In an exemplary embodiment, the holder 120 is comprised of a corrosion resistant metal, such as aluminum, stainless steel or zinc coated steel.

The tip of the marker 140 extends to a plane (i.e., a flat surface on which a straight line joining any two points on it would wholly lie). The bottom of the lower wheels 180, 185 of the cart 160 also extend to a plane. While the lower wheels 180, 185 ride along a floor at a floor plane, the tip of the marker 140 marks the tiles to be cut at a tile plane. The tile plane and floor plane may be level, parallel but at different elevations, or uneven.

The cart 160 includes a generally vertical channel 161 for receiving at least a portion of the vertical segment 115 of the rail 105. A screw 190 is threadedly received by the cart 160 in alignment with the channel 161. When tightened, the screw 190 secures the vertical segment 115 in the channel 161 of the cart 160. When the screw 190 is loosened, the cart 160 may pivot relative to the rail 105. Thus, the screw 190 performs the function of a set screw.

A plurality of wheels are provided on the cart 160. Some of the wheels 180, 185 rotate about horizontal axes. These wheels 180, 185 (lower wheels) rotate along the floor. Other wheels 170, 175 rotate about vertical axes. These wheels 170, 175 (upper wheels) rotate along a wall surface. The upper wheels each have a diameter that is sufficient to position the cart 160 away from a baseboard. This configuration allows the upper wheels 170, 175 to touch the wall or upper part of a baseboard, while maintaining a distance between the body of the cart 160 and the bottom (thicker) part of the baseboard, while the device is moving. Shoe molding and quarter round at the bottom of a baseboard is preferably removed before the device is used for marking. The removed shoe molding and quarter round may be replaced after tile installation. In other embodiments, axes of both upper wheels can be adjustable (can be moved or re-positioned in horizontal plane), instead of making diameters of the wheels bigger. The wheels 170, 175, 180, 185 are preferably non-marring, such as plastic or rubber, and provide good traction. The upper wheels 170, 175 are orthogonal to the lower wheels 180, 185.

The wheels 170, 175, 180, 185 may be replaceable. A bolt may be removed to release each wheel. In this manner wheels having various compositions, diameters, and widths may be installed.

The exemplary cart 160 is a generally cuboid in shape. However, other shapes, including cylindrical, may be utilized without departing from the scope of the invention.

The length, width and depth of the cart 160 should be sufficient to support the wheels 170, 175, 180, 185, and receive the screw 190 and engaged portion of the vertical segment 115 of the rail 105. In one exemplary embodiment, the cart 160 is about 6 inches long, 0.75 inches in width and 1.5 inches in depth (height), with the center of the channel 161 being about 3 inches (centered along the 6 inch length) from an end and about ⅜-inch from a side surface (i.e., centered between the sides), and extends downwardly about 1.25 inches (i.e., less than the full depth).

The exemplary cart 160 is removable and adjustable. The cart 160 may be fixed to the rail 105 by tightening the screw 190. Alternatively, the cart 160 may be free to pivot relative to the rail 105 by loosening the screw 190. The distance between the horizontal segment 110 of the rail 105 and the top of the cart 160 may be increased or decreased, within a range determined by the length of the vertical segment 115, the depth of the channel 161, and the position of the screw 190. The cart 160 may be removed by loosening the screw 190 and sliding the cart 160 off the vertical segment 115.

The cart 160 may be comprised of any material suitable for providing a supportive structure (i.e., body) for the wheels 170, 175, 180, 185 and receiving the vertical segment 115 and the screw 190. Plastics, metals and composites may be used. In an exemplary embodiment, the cart 160 is comprised of a corrosion resistant metal, such as aluminum, stainless steel or zinc coated steel.

Figure 5:
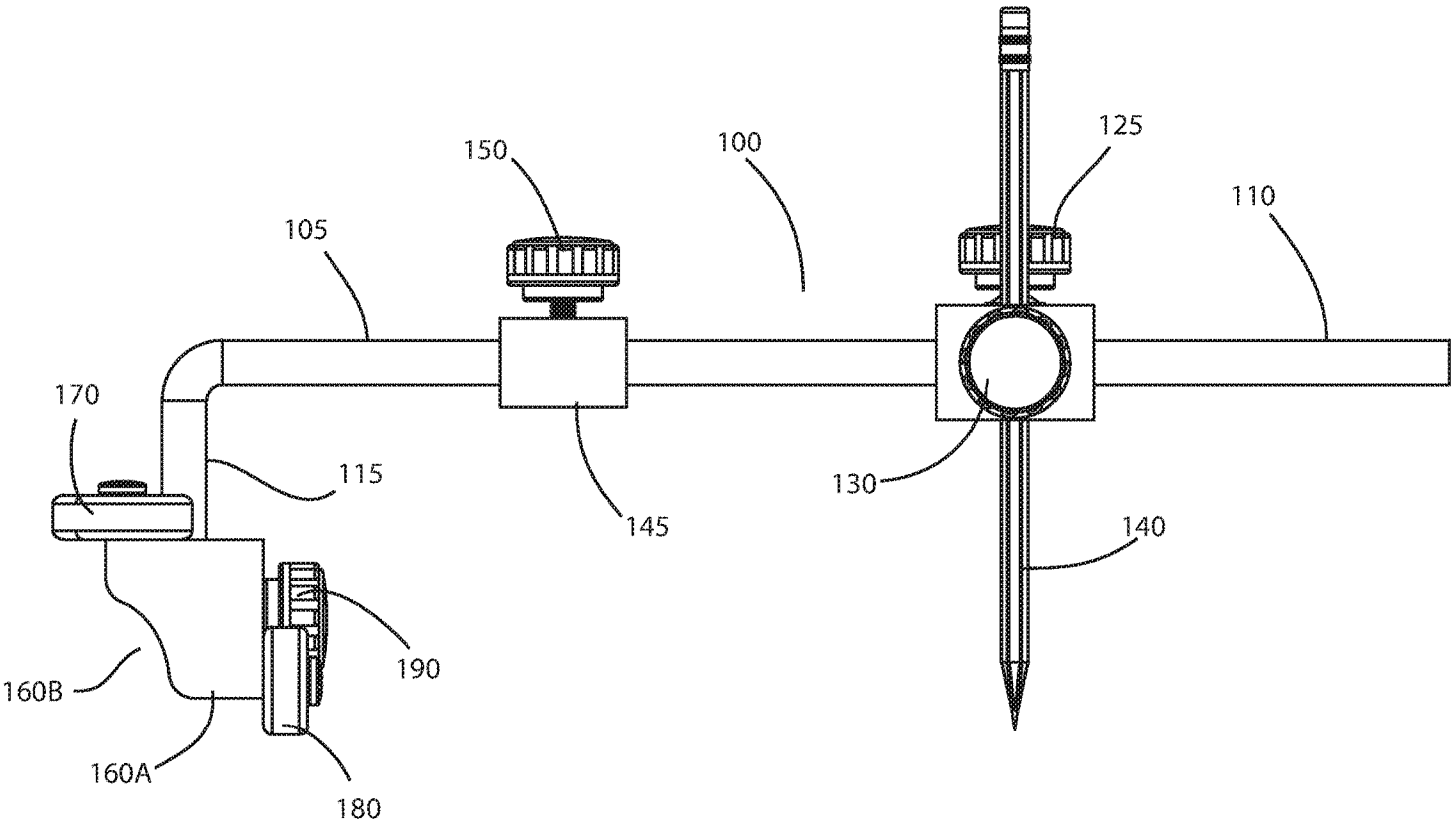
FIG. 5 is a side view of another exemplary tile cut marker tool according to principles of the invention.
Figure 6:
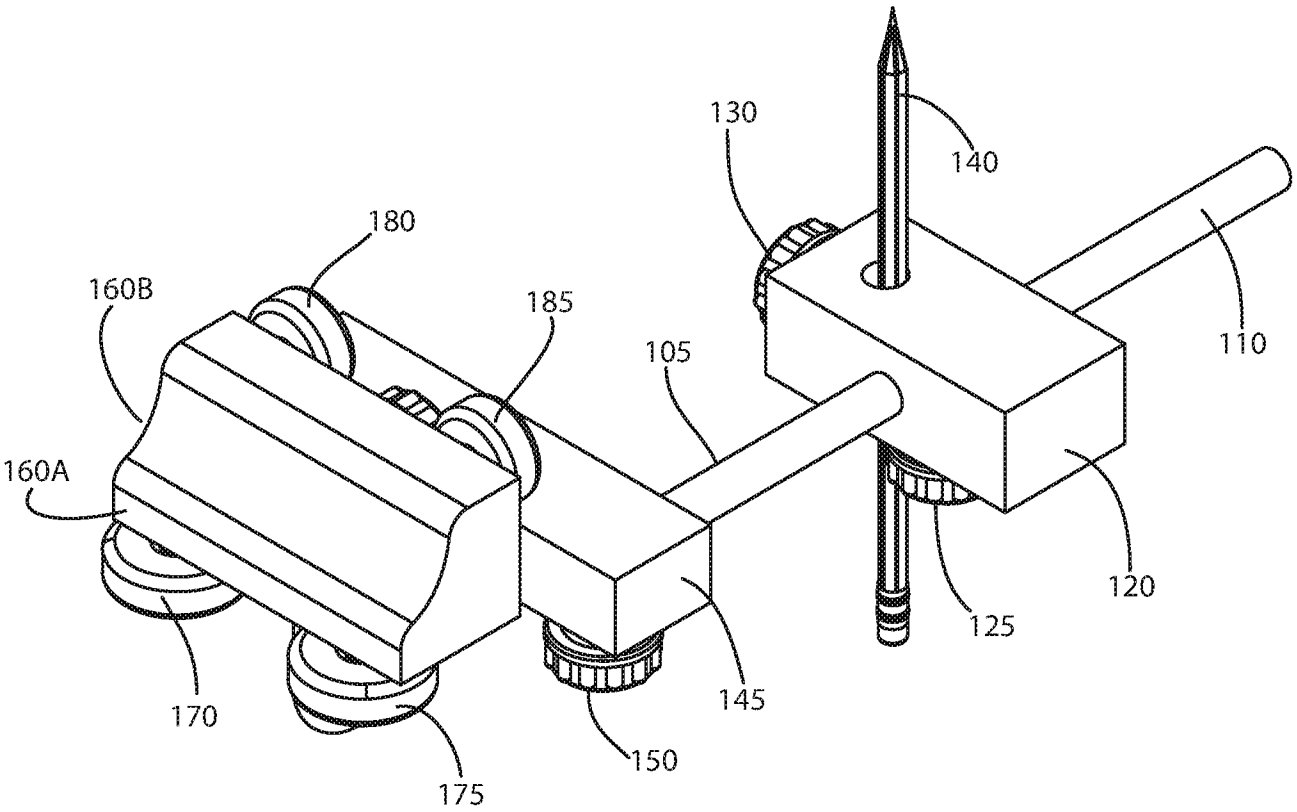
FIG. 6 is a top perspective view of the exemplary tile cut marker tool of FIG. 5 according to principles of the invention.

FIGS. 5 and 6 illustrate a cart with a concave cove 160B formed in the wall-facing side 160A. The cove 160B is sized and shaped to receive a low (thicker) portion of a baseboard, allowing the wheels 170, 175 to contact the wall or upper part of baseboard, without interference from the molding bottom part of the baseboard.

Figure 7:
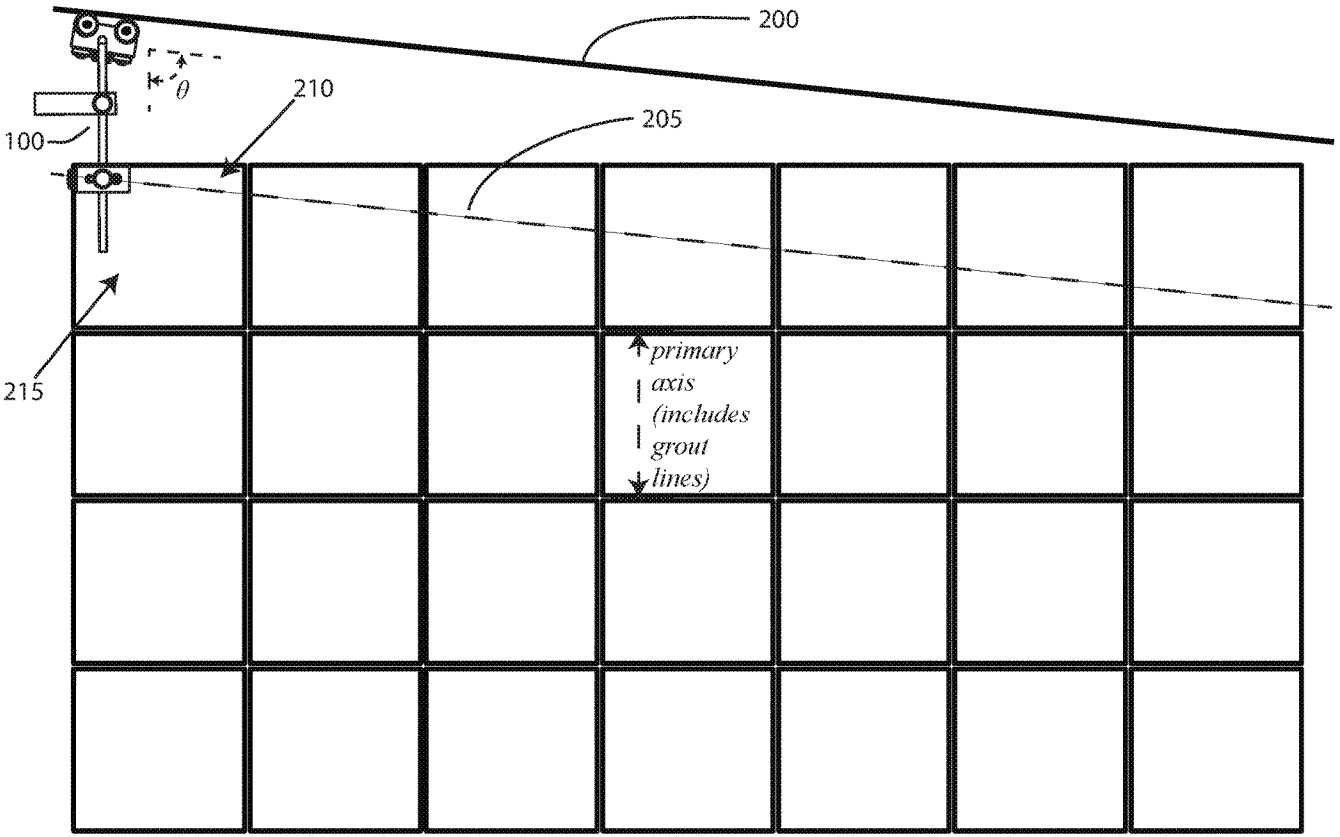
FIG. 7 is a schematic that illustrates use of an exemplary tile cut marker tool according to principles of the invention.

Referring now to FIG. 7, a schematic that illustrates use of an exemplary tile cut marker tool according to principles of the invention is provided. In use, tiles to be cut are laid in place on a floor, leaving empty the last space, less than one full tile length (including spacing for grout lines) from the boundary. The tiles to be cut may be placed on top of previously laid tiles for marking, or may be placed on the ground. As the cart of the marking tool travels against the wall 200, the pencil (positioned one full tile length from the boundary including space for grout lines) draws a cut line 205 on the laid tiles, which should be cut later. The cut line 205 in FIG. 7 is straight, as is the wall 200. The tiles are cut along the line. Those tiles will then be laid as the last row adjacent the wall 200, while another uncut row of takes their place where marked.

In the implementation of FIG. 7, the rail 105 of the tool 100 is fixed relative to the cart 160 and wall 200, with the rail 105 aligned substantially parallel to the side edges of the tiles. As the tool 100 is moved across the tiles to be marked, the rail maintains its parallel alignment while the cart 160 of the tool 100 abuts the wall 200. Tile material on the side 210 of the cut line 205 closer to the wall 200 is waste. Tile material on the side 215 of the cut line 205 farther from the wall 200 is the last row of tiles (i.e., the cut tiles) to be laid immediately adjacent to the wall 200. Those cut tiles will then be laid as the last row adjacent the wall 200, while another uncut row of takes their place where marked.

While the wall in FIG. 7 is straight but angled, it is only one nonlimiting example of a wall in connection with which a tool 100 according to principles of the invention may be used. The tool 100 may be used with straight walls at any angle, with walls having a portion at a first angle and one or more additional portions at one or more other angles. The angle of the cart may be readily adjusted for each differently angled portion.

Figure 8:
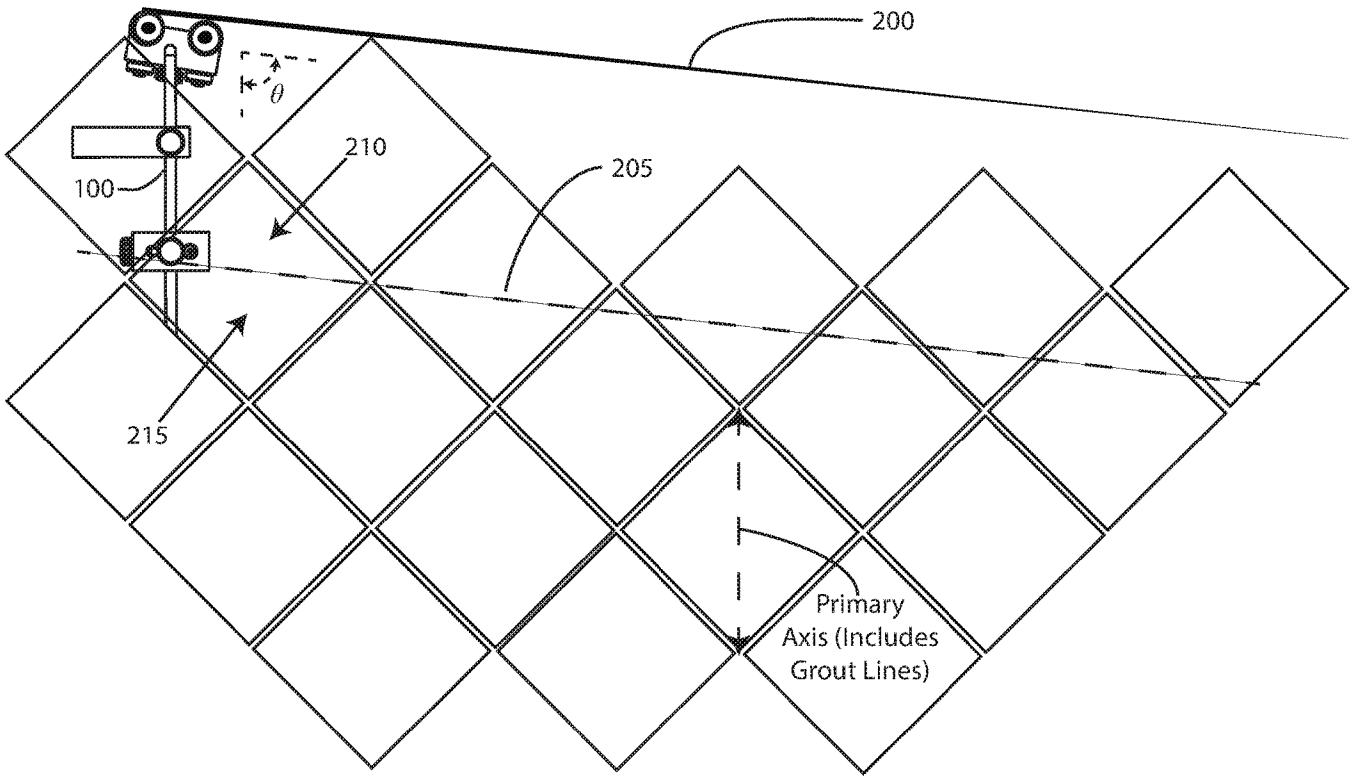
FIG. 8 is another schematic that illustrates use of an exemplary tile cut marker tool according to principles of the invention.

FIG. 8 provides another schematic that illustrates use of an exemplary tile cut marker tool according to principles of the invention. In this case, the tiles are arranged in a diamond pattern, with one angle of each full tile positioned towards the wall. The rail 105 of the tool is oriented substantially parallel to a line extending through opposed angles of each full tile along the cut line, with one of the opposed angles being the angle closest to the wall. The process for marking proceeds as with FIG. 7.

Figure 9:
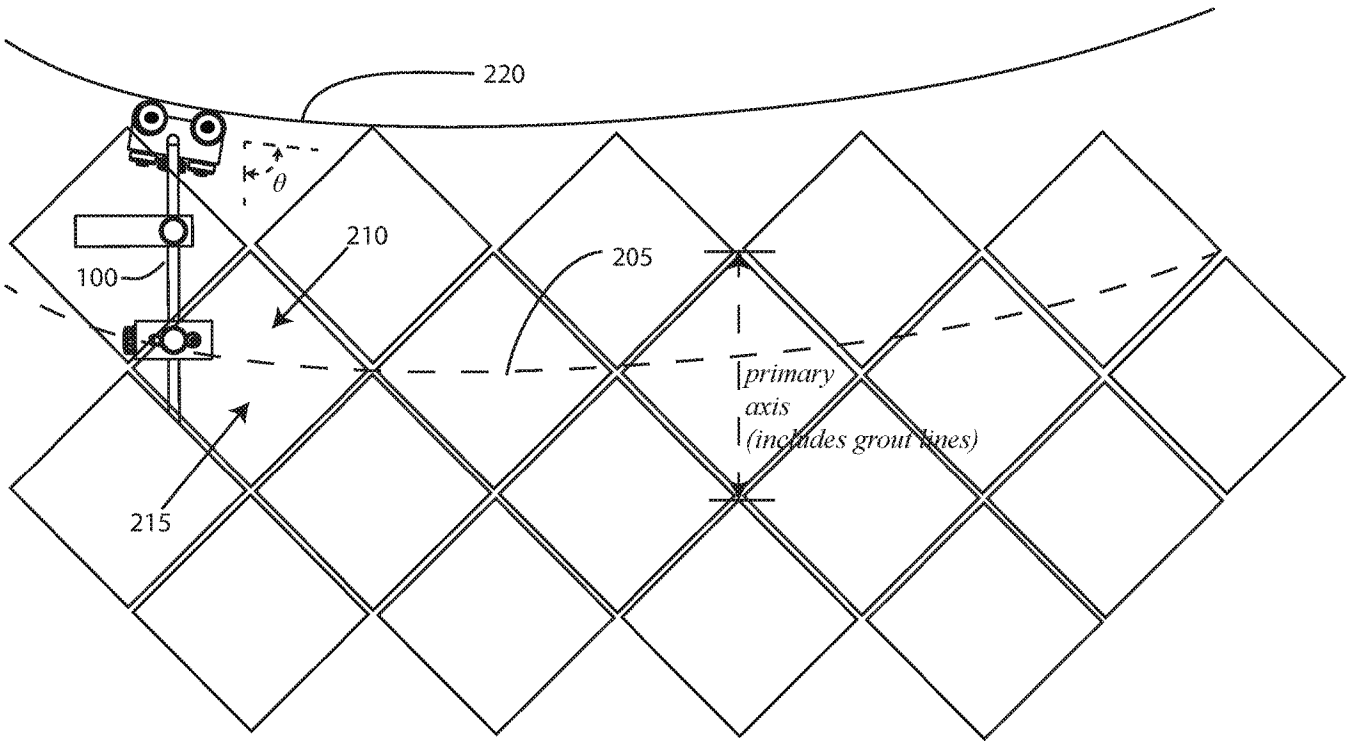
FIG. 9 is another schematic that illustrates use of an exemplary tile cut marker tool according to principles of the invention.

FIG. 9 is yet another schematic that illustrates use of an exemplary tile cut marker tool 100 according to principles of the invention. With a curved wall 220, the cart 160 is allowed to pivot. This is accomplished by loosening the screw 190 that secures the vertical portion 115 of the rail 105 in the channel 161. As the tool 100 is advanced, with the cart 160 against the wall, the rail 105 is maintained parallel to the primary axis, which, in this case, is the axis extending through opposed angles of each full tile along the cut line, with one of the opposed angles being the angle closest to the wall. The process for marking proceeds as with FIG. 7. It does not matter if the wall has a concave, convex or compound curvature. For a curved wall the cart 160 is allowed to pivot.

Thus, a tile cut marking tool 100 according to principles of the invention facilitates marking tiles regardless of the shape and orientation of the boundary (e.g., wall). Whether a wall is curved or straight, angled or not, the tool 100 facilitates marking the last row of tiles that will abut the boundary. The marker 140 (e.g., pencil) may be positioned at an appropriate distance from the wall for the particular tile being marked. The bubble level 122 helps ensure that the rail is maintained in horizontal alignment. The handle 145 is disposed between the marker 140 and cart 160. The handle 145 may also be oriented to one side of the rail 105 or the other side of the rail 105, for the convenience of the user and for improved stability. In a preferred implementation, the handle 145 is fixed a little closer to the wall than to the marker. This enhances stability while moving. It also prevents the device from rolling over, when lower (floor) wheels meet little obstacles on the floor. The upper wheels 170, 175 of the cart 160 ride along the wall or baseboard even when quarter round or shoe molding is present the bottom of the baseboard is thicker that top of the baseboard. The lower wheels 180, 185 ride along the floor for easy traverse. The rail 105 may be fixed at an angle relative to the cart 160, for use with walls that are not curved. Additionally, the rail 105 may be allowed to pivot relative to the cart 160, for use with walls that are not curved.

While an exemplary embodiment of the invention has been described, it should be apparent that modifications and variations thereto are possible, all of which fall within the true spirit and scope of the invention. With respect to the above description then, it is to be realized that the optimum relationships for the components and steps of the invention, including variations in order, form, content, function and manner of operation, are deemed readily apparent and obvious to one skilled in the art, and all equivalent relationships to those illustrated in the drawings and described in the specification are intended to be encompassed by the present invention. The above description and drawings are illustrative of modifications that can be made without departing from the present invention, the scope of which is to be limited only by the following claims. Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents are intended to fall within the scope of the invention as claimed.

What is claimed is:

1. A tile cut marking device comprising:

a support structure comprising an elongated support and having a first end and a second end; and a cart, a pivotable joint connecting the first end of the support structure to the cart, the cart comprising a cart body to which a plurality of wheels are attached, the cart body having a bottom surface, a top surface opposite the bottom surface, a first side surface extending from the top surface to the bottom surface, and a second side surface opposite the first side surface and extending from the top surface to the bottom surface, the plurality of wheels including a pair of lower wheels attached to the first side surface and extending equally below the bottom surface, and at least one upper wheel attached to the top surface and extending outwardly beyond the second side surface, an axis of rotation of each lower wheel of the pair of lower wheels being horizontal, and an axis of rotation of each upper wheel of the at least one upper wheel being vertical, the distance between the top surface and the bottom surface being at least 0.75 inches; and a marker holder attached to the support structure between the cart and the second end of the support structure, the marker holder including a holder body;

a marking instrument attached to the marker holder, the marking instrument including an end with a marking tip, the end with the marking tip extending downwardly below the marker holder a determined distance for marking.

2. A tile cut marking device according to claim 1, further comprising a handle attached to the support structure between the cart and marker holder.

3. A tile cut marking device comprising:

a support structure comprising an elongated support and having a first end and a second end; and a cart attached at the first end of the support structure, the cart comprising a cart body to which a plurality of wheels are attached, the cart body having a bottom surface, a top surface opposite the bottom surface, a first side surface extending from the top surface to the bottom surface, and a second side surface opposite the first side surface and extending from the top surface to the bottom surface, the plurality of wheels including a pair of lower wheels attached to the first side surface and extending equally below the bottom surface, and at least one upper wheel attached to the top surface and extending outwardly beyond the second side surface, an axis of rotation of each lower wheel of the pair of lower wheels being horizontal, and an axis of rotation of each upper wheel of the at least one upper wheel being vertical, the distance between the top surface and the bottom surface being at least 0.75 inches; and a marker holder attached to the support structure between the cart and the second end of the support structure, the marker holder including a holder body;

a marking instrument attached to the marker holder, the marking instrument including an end with a marking tip, the end with the marking tip extending downwardly below the marker holder a determined distance for marking;

the at least one upper wheel attached to the top surface and extending outwardly beyond the second side surface comprising a pair of upper wheels, each of the pair of upper wheels being attached to the top surface, and the pair of upper wheels extending equally outwardly beyond the second side surface.

4. A tile cut marking device according to claim 3, the elongated support comprising a bent rod with a vertical segment and a horizontal segment, the horizontal segment being longer than the tile to be marked.

5. A tile cut marking device according to claim 4, the cart body including a channel in which a portion of the vertical segment is received, and a screw threadedly received in the cart body and, when the screw is tightened, extending into the channel and exerting force against the portion of the vertical segment received in the channel, and, when the screw is loosened, not applying force against the portion of the vertical segment received in the channel.

6. A tile cut marking device according to claim 4, the holder body including a horizontal channel in which a portion of the horizontal segment is received, and a first screw threadedly received in the holder body and, when the first screw is tightened, extending into the horizontal channel and exerting force against the portion of the horizontal segment received in the horizontal channel, and, when the first screw is loosened, not applying force against the portion of the horizontal segment received in the horizontal channel.

7. A tile cut marking device according to claim 4, the holder body including a vertical channel in which a portion of the marking instrument is received, and a second screw threadedly received in the holder body and, when the second screw is tightened, extending into the vertical channel and exerting force against the portion of the marking instrument received in the vertical channel, and, when the second screw is loosened, not applying force against the portion of the marking instrument received in the vertical channel.

8. A tile cut marking device according to claim 3, the marker holder being positioned a determined marking distance from the first end.

9. A tile cut marking device according to claim 3, the holder body including a top surface and a bubble level attached to the top surface of the holder body.

10. A tile cut marking device according to claim 3, further comprising a handle attached to the support structure between the cart and marker holder, the handle including a horizontal channel in which a portion of the horizontal segment is received, and a second screw threadedly received in the handle and, when the second screw is tightened, extending into the horizontal channel and exerting force against the portion of the horizontal segment received in the horizontal channel, and, when the second screw is loosened, not applying force against the portion of the horizontal segment received in the horizontal channel.

11. A tile cut marking device according to claim 3, the at least one upper wheel attached to the top surface and extending outwardly beyond the second side surface comprising a pair of upper wheels, each of the pair of upper wheels being attached to the top surface, and the pair of upper wheels extending equally outwardly beyond the second side surface.

12. A tile cut marking device according to claim 11, the elongated support comprising a bent rod with a vertical segment about 3 to 5 inches in length and a horizontal segment about 20 to 26 inches in length.

13. A tile cut marking device according to claim 12, the cart body including a vertical channel in which a portion of the vertical segment is received, and a first screw threadedly received in the cart body and, when the first screw is tightened, extending into the vertical channel and exerting force against the portion of the vertical segment received in the vertical channel, and, when the first screw is loosened, not applying force against the portion of the vertical segment received in the vertical channel.

14. A tile cut marking device according to claim 13, the holder body including a first horizontal channel in which a portion of the first horizontal segment is received, and a second screw threadedly received in the holder body and, when the second screw is tightened, extending into the first horizontal channel and exerting force against the portion of the first horizontal segment received in the first horizontal channel, and, when the second screw is loosened, not applying force against the portion of the first horizontal segment received in the first horizontal channel.

15. A tile cut marking device according to claim 14, the holder body including a second vertical channel in which a portion of the marking instrument is received, and a third screw threadedly received in the holder body and, when the third screw is tightened, extending into the second vertical channel and exerting force against the portion of the marking instrument received in the second vertical channel, and, when the third screw is loosened, not applying force against the portion of the marking instrument received in the second vertical channel.

16. A tile cut marking device according to claim 15, the marker holder being positioned a determined marking distance from the first end.

17. A tile cut marking device according to claim 16, the holder body including a top surface and a bubble level attached to the top surface of the holder body.

18. A tile cut marking system comprising:

a wall, a floor, and a plurality of tiles arranged on the floor apart from the wall; and an elongated support having a first end and a second end; and a cart attached at the first end of the elongated support, the cart comprising a cart body to which a plurality of wheels are attached, the cart body having a bottom surface, a top surface opposite the bottom surface, a first side surface extending from the top surface to the bottom surface, and a second side surface opposite the first side surface and extending from the top surface to the bottom surface, the plurality of wheels including a pair of lower wheels attached to the first side surface and extending equally below the bottom surface, and a pair of upper wheels attached to the top surface and extending equally outwardly beyond the second side surface, an axis of rotation of each lower wheel of the pair of lower wheels being horizontal, and an axis of rotation of each upper wheel of the pair of upper wheels being vertical, the distance between the top surface and the bottom surface being at least 0.75 inches, and the pair of upper wheels of the cart abutting the wall and the pair of lower wheels abutting the floor; and a marker holder attached to the elongated support between the cart and the second end of the elongated support, the marker holder including a holder body;

a marking instrument attached to the marker holder, the marking instrument including an end with a marking tip, the end with the marking tip extending downwardly below the marker holder a determined distance for marking the plurality of tiles arranged on the floor; and a handle attached to the elongated support between the cart and marker holder.

19. A tile cut marking device according to claim 18, the elongated support comprising a bent rod with a vertical segment and a horizontal segment, the horizontal segment being longer than the tile to be marked.

20. A tile cut marking device according to claim 19, the holder body including a top surface and a bubble level attached to the top surface of the holder body.

* * * * *